US007181849B2

(12) United States Patent
Menter

(10) Patent No.: US 7,181,849 B2
(45) Date of Patent: Feb. 27, 2007

(54) FOLDING KNIFE WITH OPENING AND CLOSING ACTUATOR

(76) Inventor: Mark Menter, 8991 S. Washington St., Littleton, CO (US) 80122

( * ) Notice: Subject to any disclaimer, the term of this patent is extended or adjusted under 35 U.S.C. 154(b) by 137 days.

(21) Appl. No.: 10/878,760

(22) Filed: Jun. 28, 2004

(65) Prior Publication Data

US 2005/0283982 A1 Dec. 29, 2005

(51) Int. Cl.
*B26B 1/02* (2006.01)

(52) U.S. Cl. ..... 30/159; 30/155

(58) Field of Classification Search ..... 30/151–163; 132/76.2; D8/99; 7/118, 168; 81/3.35
See application file for complete search history.

(56) References Cited

U.S. PATENT DOCUMENTS

| | | | | | |
|---|---|---|---|---|---|
| 23,975 | A | | 5/1859 | Belcher | |
| 338,853 | A | | 3/1886 | Marks | |
| 543,943 | A | | 8/1895 | Minter | |
| 553,430 | A | | 1/1896 | Schmachtenberg | |
| 557,818 | A | | 4/1896 | Hotchkiss | |
| 689,513 | A | | 12/1901 | Papendell | |
| 749,230 | A | | 1/1904 | Severance | |
| 947,980 | A | | 2/1910 | Romano | |
| 1,422,363 | A | | 7/1922 | Johnson | |
| 1,495,449 | A | | 5/1924 | Sibley et al. | |
| 2,304,601 | A | | 12/1942 | Schrade | |
| 3,009,245 | A | * | 11/1961 | Senkewitz | 30/155 |
| 4,083,110 | A | | 4/1978 | Goldin et al. | |
| 4,133,106 | A | | 1/1979 | Addis | |
| 4,356,631 | A | | 11/1982 | Guth | |
| 4,535,539 | A | | 8/1985 | Friedman et al. | |
| 4,536,959 | A | | 8/1985 | Ross | |
| 4,551,917 | A | | 11/1985 | Walker | |
| 4,612,706 | A | | 9/1986 | Yunes | |
| 4,670,984 | A | | 6/1987 | Rickard | |
| 4,805,303 | A | | 2/1989 | Gibbs | |
| 4,811,486 | A | | 3/1989 | Cunningham | |
| 4,947,551 | A | | 8/1990 | Deisch | |
| 4,974,323 | A | | 12/1990 | Cassady | |
| 5,044,079 | A | | 9/1991 | Gibbs | |
| 5,060,379 | A | | 10/1991 | Neeley | |
| 5,293,690 | A | | 3/1994 | Cassady | |
| 5,495,674 | A | | 3/1996 | Taylor, Jr. | |
| 5,815,927 | A | * | 10/1998 | Collins | 30/161 |
| 5,964,036 | A | * | 10/1999 | Centofante | 30/161 |
| 5,979,065 | A | | 11/1999 | Hsu | |
| 6,079,106 | A | * | 6/2000 | Vallotton | 30/161 |
| 6,158,127 | A | * | 12/2000 | Taylor | 30/158 |
| 6,427,333 | B1 | * | 8/2002 | Veltz et al. | 30/158 |
| 6,438,848 | B1 | * | 8/2002 | McHenry et al. | 30/161 |
| 6,574,869 | B1 | * | 6/2003 | McHenry et al. | 30/161 |
| 6,951,055 | B1 | * | 10/2005 | Collins | 30/162 |
| 2003/0070299 | A1 | | 4/2003 | Frazer | |
| 2004/0244205 | A1 | * | 12/2004 | Linn et al. | 30/159 |

* cited by examiner

*Primary Examiner*—Boyer D. Ashley
*Assistant Examiner*—Laura M. Brean
(74) *Attorney, Agent, or Firm*—Leyendecker and Lemire, LLC; Kurt Leyendecker

(57) ABSTRACT

In one embodiment of the present invention a laterally folding knife is described incorporating an actuator mechanism permitting the knife blade to be moved from open and closed positions without the need for a user to touch the blade. Further, the folding knife can be quickly opened or closed using a single finger or thumb. The knife blade is automatically locked in place in either open or closed position and therefore does not require a separate blade locking mechanism.

19 Claims, 4 Drawing Sheets

FOLDING KNIFE WITH OPENING AND CLOSING ACTUATOR

FIELD OF THE INVENTION

This invention generally relates to folding knives or other folding hand tools. More particularly, this invention pertains to folding knives or folding tools that include a handle mounted actuator to move the knife or tool between open and closed positions.

BACKGROUND

Folding knives are well known in the art and have been around for centuries. In the most common types of folding knives, a knife blade pivots at its tang moving in a plane of the blade between a closed position wherein it is substantially contained in the knife handle to an open position with the blade extended. Typically, a locking mechanism of some sort is provided to hold or bias the blade in either position. In some knives, the locking mechanism may merely comprise a biasing spring the increases the force necessary to pivot the blade, thereby decreasing the likelihood of the blade accidentally or unintendedly being moved from one position to another. Other folding knives provide a more positive locking mechanism particularly to hold the knife in its open position that requires a user to move a lever or push a button to move the knife back into its closed or retracted position.

Most typically, folding knives require the user to grab the side of the knife blade opposite a blade's cutting edge to pull and pivot the blade from the closed to open position. Generally, this requires two hands: one to hold the handle of the knife; and the other to grab, pull and pivot the blade. Closing the blade is usually easier as the user can brace the backside of the blade against his leg or body while holding and applying a pivotal force to the handle to move the blade into the closed position. However, when moving the blade into the closed position, the user must take great care to make sure his/her fingers are not wrapped around the opening into which the blade is to be received otherwise the user risks injury of having the cutting edge of the blade slicing into the fingers.

Folding knives commonly referred to as "switchblades" that automatically move the blade from the closed to open position are also well known. Switchblades typically utilize a spring that biases the knife blade towards the open position. The blade is generally held in its closed position by a pin or suitable latch that when intentionally (or accidentally) released by the user pushing or pulling an associated trigger causes the blade to rapidly swing from the closed position to the open position. As can be appreciated, the tip of the blade moves very fast and can potentially pierce or cut anything that interferes with its path. Because the action of closing the blade biases the spring to store the energy necessary to facilitate quick and effortless opening of the blade, a switch blade is typically much more difficult to safely close than a traditional manually actuated folding knife.

Perhaps the most significant disadvantage of switchblades is restrictions on their possession and sale as dictated by United States code 15 U.S.C. 29 and various state laws.

While folding knives that have blades that open by pivoting in the plane of the blade are by far the most common configuration, folding knives that have laterally opening blades, or blades that open in a plane generally perpendicular to the plane of orientation of the blade, are also known as indicated in U.S. Pat. Nos. 557,818; 1,422,363; 4,083,110 and 4,947,551. This type of blade offer several significant safety advantages over more traditional folding knives. First, because the blade on this type of knife closes laterally there is a significantly reduced chance that the blade will cut the user's fingers. If the fingers are overhanging the cavity substantially during closing the fingers will be impacted by the flat side of the blade that will not cut the user. This contrasts with the possible guillotine effect when closing a traditional folding knife. Further, because of the way a laterally folding knife opens and closes, a blade with two opposing cutting edges can be used; whereas, with a traditional folding knife the side of blade opposite the cutting edge must usually be blunt to provide the user with an edge that he/she can grab the blade to move it between the open and closed positions.

Another advantage of the laterally opening and closing folding knife results from the typical construction of the laterally folding knife as compared with a knife with a blade that folds along the plane of the blade. The handles of traditional folding knifes typically comprise two side plates orientated in planes generally parallel to the blade and one or more spacers separating the plates to provide a cavity for the blade. When opened, the blade is braced at the tang against one of the spacers to provide support against cutting forces that are typically normal to the length of the blade's cutting edge. The spacers are mechanically fastened to the plates and accordingly, represent a potentially weak link in the knife. In other words, if the user presses down with great force on the object he/she is cutting, there is a possibility the spacer could break or detach from one or both of the side plates. In contrast, the handles of many laterally opening folding knives are monolithic and do not have a weak point such as a spacer. Further, in other laterally opening folding knife designs using side plates, the side plates are orientated generally perpendicularly to the plane of the blade such that the tang of the blade is braced against a side plate and not a weaker spacer one cutting forces are applied. Ultimately, this results in a stronger knife.

There are, however, several disadvantages to prior art laterally folding knives. First, they can be rather difficult to open as there is no exposed edge of the blade to grab onto to pull the blade from its cavity in the handle. Accordingly, other means of opening the blade must be provided. For instance, in U.S. Pat. No. 4,083,110 a portion of the tang extends behind the blade's pivotal connection with the handle. A user opens the blade by swinging a portion of the tang located behind the pivot. In other designs, such as in U.S. Pat. No. 557,818, both sides of the blade are exposed on either side of the handle such that a user swings the blade open the pushing the blade from one side and swinging out the other. In U.S. Pat. No. 4,947,551, the blade is opened presumably using gravity swinging out two of the handle cavity after user releases a lock that holds the blade in the closed position. It is appreciated, however, depending on how gravity is utilized to assist the opening of a laterally pivoting blade, the knife may qualify as a switchblade under United States code 15 U.S.C. 29 which defines switchblade as knives that open automatically as described above including those that open automatically by way of inertia or gravity. Laterally folding knives that are capable of being opened or closed by way of user operated and controlled actuators are unknown.

A second and perhaps even more significant disadvantage of prior art laterally opening folding knives is the manner in which the blade of the knife is locked in place. For instance, in U.S. Pat. No. 4,083,110 a user must slide a set through the pivot shaft to lock the blade. In U.S. Pat. No. 557,818, a user must slide back a lock mechanism to release the blade and then must slide the lock mechanism forward to lock the blade in the open position. In U.S. Pat. No. 4,947,551, the user must also release a spring biased lock before he can open or close the knife. The prior art references relating to laterally opening folding knives either do not cause the blade to be locked in place automatically with the opening or closing of the blade or require the actuation of a separate lock release to facilitate opening and/or closing. This makes the use of the laterally opening folding knife less convenient than the more traditional variety.

Concerning more traditional folding knives which pivot in the plane of the blade, several different types of actuator mechanisms for either opening the knife and/or closing the knife have been proposed in the prior art. Given the orientation of the blade and the manner in which these knives are opened and closed, they still suffer from many of the disadvantages described above concerning traditional folding knives and switchblades. Many laterally opening folding knife designs incorporating an actuator only permit that actuator to be used to move the knife from a closed to an open position. In others, the user must release a lock before retracting the blade into the closed position. Even those that permit the blade to be both opened in closed by way of an actuator, nothing resolves the safety related problem of potentially swinging and knife edge of the blade on to a user's fingers. Another drawback of prior art actuator mechanisms is that they are relatively complex, and accordingly, increase the cost to manufacture a folding knife incorporating the actuator substantially. Ultimately, the complexity of the actuator mechanisms combined with increased safety risk when compared to manually opening traditional folding knives are significant disadvantages that prevented their widespread use.

SUMMARY OF THE INVENTION

In a first preferred embodiment of the present invention a folding knife is described. The folding knife comprises a knife blade, a handle with a cavity, and an actuator mechanism. The knife blade has at least one knife edge and a tang. The handle is pivotally connected with the tang along a pivot axis. The pivot axis is one of (i) coincident with the plane of the knife blade and (ii) parallel to the plane of the knife blade, wherein the knife blade is movable about the pivotal connection between a closed position with the blade substantially contained within the cavity and an open position with the knife blade extending outwardly from an end of the handle and being generally longitudinally aligned with the handle. The actuator mechanism is coupled to the knife blade and the handle, and is adapted to permit a user to move the knife blade between the open and closed positions using a single digit of a single hand holding the knife without touching the knife blade.

In a second preferred embodiment of the present invention an actuator mechanism for use in conjunction with a folding tool that facilitates the pivotal movement of an implement of the folding tool between a closed position wherein the implement is at least partially contained within a handle of the folding tool and an open position wherein the implement is extended from the handle in a position for use is described. The actuator mechanism comprises a tang at the base of the implement, a pushing element with opposing first and second ends, a shaft, and at least one generally arcuate slot with at least a portion of the shaft extending through the slot. The tang has a longitudinal axis and is pivotally coupled with the handle along a pivot axis for movement between the open and closed positions. The pivot axis is generally perpendicular to the longitudinal axis. The pushing element is slidably coupled to the tang. The shaft is pivotally coupled with the pushing element and extends longitudinally in a direction generally perpendicular to the longitudinal. The slot has a front end and a rear end. Accordingly, the actuator moves the implement between the open and closed positions in reaction to the sliding of the shaft along the at least one arcuate slot from one of the front and rear ends to the other of the front and rear ends.

In a third preferred embodiment of the present invention a handheld folding tool is described. The folding handheld tool comprises (i) an elongated handle including one or more pieces, (ii) at least one implement pivotally coupled to the handle proximate the first or second end for movement between an open position with a substantial portion of the al least one implement extending out of the at least one cavity and a closed position with the at least one implement substantially contained within the at least one cavity, and (iii) at least one actuator mechanism coupled to both the at least one implement and the handle. The handle has a first end and an opposing second end, the handle includes at least one internal cavity. The at least one actuator mechanism includes (a) at least one slot formed in the handle, (b) a shaft extending through the at least one slot, (c) at least one of the shaft adapted for manual engagement with a finger of a person, and (d) a sliding element. The sliding element is pivotally coupled with shaft and slidably coupled with one end of the at least one implement for slidable movement relative to the end of the at least one implement in a longitudinal direction of the at least one implement. The at least one implement is movable between both the open and closed positions by moving the shaft along the at least one slot.

DETAILED DESCRIPTION

Figure 1:
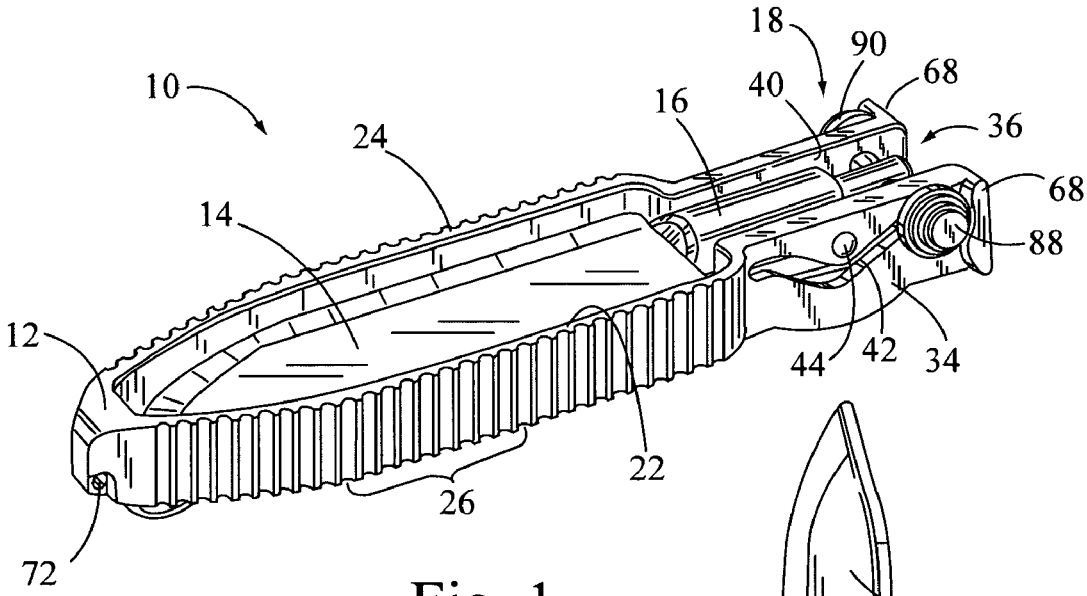
FIG. 1 is an isometric front view of one embodiment of the present invention with the knife blade in a closed or retracted position.

One embodiment of the current invention comprises a laterally opening folding knife that incorporates a user-activated actuator mechanism to facilitate safe single handed opening and closing of the blade. The knife provides all the advantages of prior art laterally folding knives but none of their disadvantages. For instance, the actuator mechanism self locks the blade in both its open and closed positions, and accordingly, does not require an additional locking mechanism for proper and safe use of the knife. The knife is extremely easy to open and close by way of a sliding the button-ended actuator shaft in a generally arcuate slot formed in the side of the knife's handle/housing. Additionally, the one embodiment knife can withstand very high cutting forces as the tang is braced directly against the side wall of the handle/housing.

Preferred embodiments of the actuator mechanism are extremely simple and provide for both economical manufacture and increased versatility for any knife or other foldable tool on which it is used. Simply, the mechanism comprises only three or four additional parts over a standard non-actuated folding knife: (i) the aforementioned button-ended actuator shaft; (ii) a threaded button nut for securement to a threaded end of the button-ended shaft; (iii) an actuator piston (or pushing element) that is slidably received in a longitudinal bore formed in the blade's tang; and optionally (iv) a coil spring that acts as an interface between the actuator piston and the end of the tang's bore to smooth out operation of the mechanism and to bias the button ended shaft toward either end of the arcuate slot formed in the knife's handle. The particular design of the actuator as is described in detail below obviates the need for an additional locking mechanism further increasing the economy of manufacturer of the knife. It is further appreciated that the design of the knife in general and the described actuator embodiment in particular permit a manufacturer (or user) to configure a single knife for either right or left handed operation by merely flipping the blade 180 degrees such that the knife edge points in the opposite direction.

The actuator is designed to facilitate extremely rapid deployment of the blade in situations that require it, and in differing situations, the blade can be deployed silently by more slowly easing the actuator shaft along the arcuate slot. To facilitate both speed and control of the blades deployment, the actuator shaft of the mechanism is configured to be pulled rearwardly using the user's thumb. It is appreciated that a person has greater control of his/her thumb when using it in a pulling motion opposed to a pushing motion. Additionally, because of human biomechanics, a user can exert more force at a faster rate through his/her thumb pulling inwardly than pushing outwardly.

The advantages of the embodiments described herein above and below along with the particular configuration of the described embodiment(s) of the invention are not conclusive or even exhaustive but rather merely representative of the best mode of using the invention. Rather, numerous variations and other embodiments have been contemplated that read upon the appended claims and are, accordingly, intended to be within the scope of the invention.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact. For example, the button-ended actuator shaft of the actuator mechanism is operatively coupled to the tang of the knife blade even thought they are not in physical contact.

As used herein, the phrase "traditional folding knife" and variations thereof refer to a folding knife wherein the pivot axis of the blade when moving between open and closed positions is generally perpendicular to the plane of the blade.

As used herein, the phrase "laterally opening folding knife" and variations thereof refer to a folding knife wherein the axis of rotation is one of: (i) substantially contained in the plane of the blade, generally parallel to the plane of the blade and (ii) canted relative to the plane of the blade at an angle of less than 45 degrees.

The terms "blade" and "knife blade" are used repeatedly herein to refer primarily to an elongated plate-like tool with a sharp or serrated edge adapted for cutting or slicing. However, it to be appreciated that generically the term, as used herein, also is intended to refer to any implement or tool that can be utilized with the actuator mechanism and a handle/housing much in the same manner as a "blade" having a cutting or slicing edge unless specifically indicated otherwise. For example, other possible implements include, but are not limited to, a spoon, an awl, a file, a fork, scissors, a comb and a screwdriver.

The term "tang" refers to the portion of a blade or implement near the proximal end of the blade or implement at which the blade or implement is pivotally coupled with the handle.

The phrase "actuator mechanism" refers to a mechanism that is manually actuatable by a user for moving the blade from at least a closed position to an open position, and preferably also for moving the blade from the open position to the closed position. Generally, unless specifically indicated otherwise, fully automatic actuators that would fall under United States code 15 U.S.C. 29, such as those utilized in a switchblades, are not considered actuator mechanisms in the sense that the term is used herein.

It is appreciated that the term "cavity" as it is used herein in reference to the handle of the folding knife or tool refers to any suitable recess in the handle for storing the knife blade or implement when the folding tool is in the closed position. The cavity can have a single open side as shown in the illustrated laterally folding knife or it can have two or more open sides in other embodiments. In yet other embodiments, the cavity may merely comprise the surface the knife blade or implement rests upon when in its closed position.

Unless specifically stated herein, the terms "finger" or "fingers" includes a thumb or thumbs.

The term "arcuate slot" as used herein refers to any slot having a generally or even roughly arcuate shape unless specifically indicated otherwise. For instance, the specific slot described below for one embodiment has a true arcuate portion but also includes linear portions as well. For purposes of this disclosure, this slot is considered an arcuate slot. Further a v-shaped or U-shaped slot would also be considered an arcuate slot.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

One Embodiment of the Folding Tool

One embodiment of the present invention comprises a laterally folding knife 10 as illustrated in FIGS. 1–7. The folding knife includes (i) a handle 12, (ii) a knife blade 14 pivotally coupled to the handle at a tang 16 thereof, and (iii) and actuator mechanism 18 coupled between the handle and the blade for moving the blade between its closed and open positions.

As illustrated in any of FIGS. 1–5 and 7, the handle 12 is monolithic comprising a single piece. Preferably, the handle is either cast, forged or machined from an aluminum alloy. However, the handle may be comprised of other materials as well, such as, but not limited to, steel, magnesium alloy, and reinforced plastics.

Figure 4:
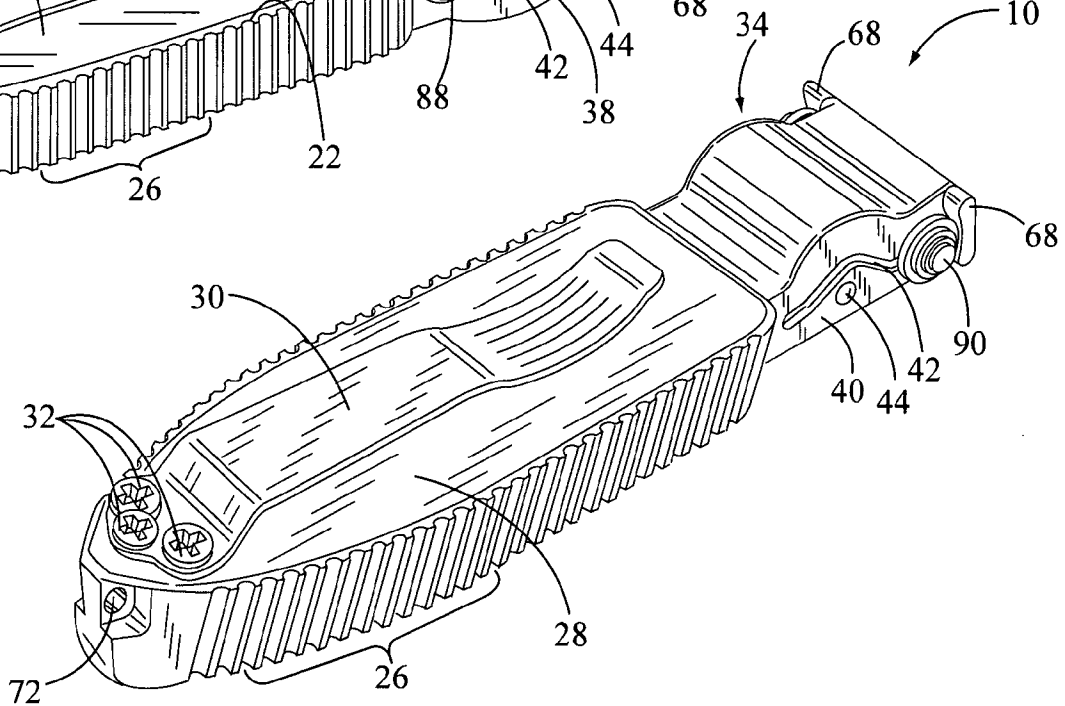
FIG. 4 is a rear isometric view of the one embodiment of the present invention with the knife blade in the closed position.

Generally, the handle forms a cavity 20 in which the knife blade 14 a substantially received when in the closed or retracted position. As illustrated, the cavity includes a top wall 22 and the bottom wall 24. The outside surfaces of these walls preferably include a ribbed pattern, which provide the user with a gripping surface 26. It is appreciated that in variations of this and other embodiments no gripping surface may be provided or other gripping surface materials may be utilized, such as rubber or plastic insets. A back wall 28 intersects with the top and bottom wall and forms the backside of the handle. As best illustrated in FIG. 4, a belt clip 30 can be attached to the back wall with screw fasteners 32 or by any suitable means.

Figure 5:
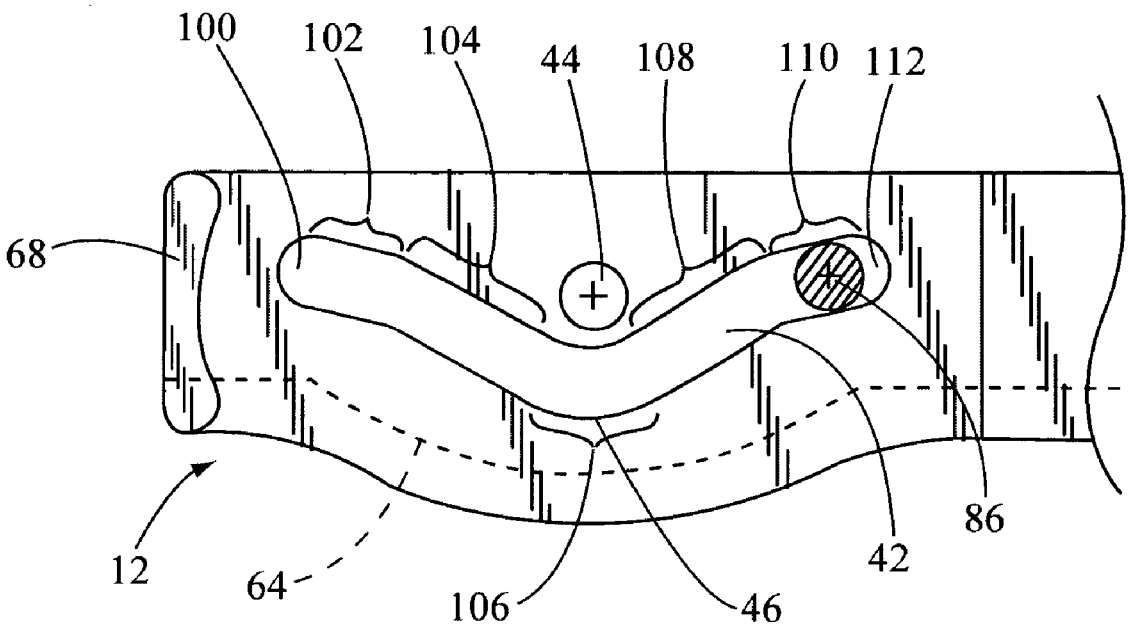
FIG. 5 is a partial side view of the one embodiment of the present invention with the actuator shaft shown in the position it is in when knife blade is in the open position.

The front portion 34 of the handle forms a channel 36 wherein the tang 16 of the knife blade 14 is received along with much of the componentry comprising the actuator mechanism 18. The top and bottom walls 38 & 40 in this portion of the handle 12 also include arcuate slots 42 that extend through each of the walls, as well as, aligned pivot pin holes 44 as best illustrated in FIG. 5. As illustrated, the center point of the pivot pin holes are vertically aligned with the nadirs 46 of the arcuate slots. The significance of the slots will become evident in the description below.

Figure 6:
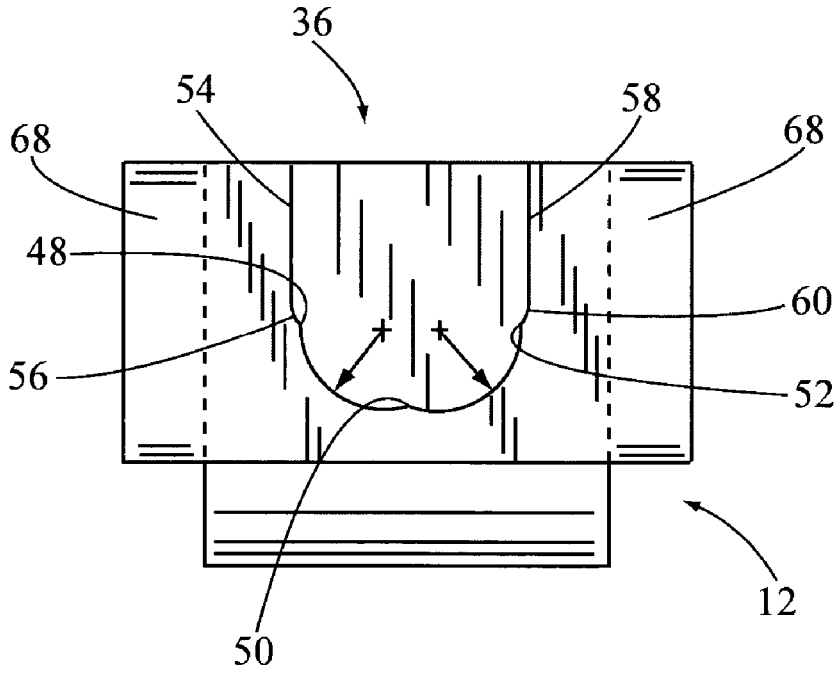
FIG. 6 is an end view of the handle of the one embodiment of the present invention.

Referring to FIG. 6, a front view of the front portion 34 of the handle 12 is illustrated. Of particular note is the configuration of the channel 36. At first glance, it appears as though the bottom of the channel has a semicircular configuration. Closer examination indicates that this is not the case. Rather, three slight ridges 48, 50 & 52 are provided: one ridge 48 at the bottom most portion of the channel; one ridge 50 on the left-hand side of the channel proximate the intersection of a vertical linear left surface 54 with a left bottom arcuate surface 56; and one ridge 52 on the right side of the channel proximate the intersection of a vertical linear right surface 58 with a right bottom arcuate surface 60. These ridges act to minimize the play between the tang 16 and the handle when the knife blade 14 is in the open position as will be described in greater detail below.

Referring back to FIG. 5, the bottom surface 64 of the channel on the back wall 28 of the handle is recessed in the region proximate the nadirs 46 of the arcuate slots 42. This recessed portion 64 provides clearance for a pushing element 66 of the actuator mechanism 18 when the knife blade 14 is moved between the open and closed positions.

Also of note concerning the handle 12 are two flanges 68 that extend outwardly of the top and bottom walls 38 & 40 at the front end of the front portion 34. As can be seen in FIG. 1, these flanges act as stops for actuator buttons 70 of the actuator mechanism 18. The flanges also act as hilts to help prevent the user's fingers from sliding forward onto the blade. Further, on the opposite back end of the handle, a hole 72 is provided through which lanyard can be attached to the folding knife to facilitate carrying.

Figure 7:
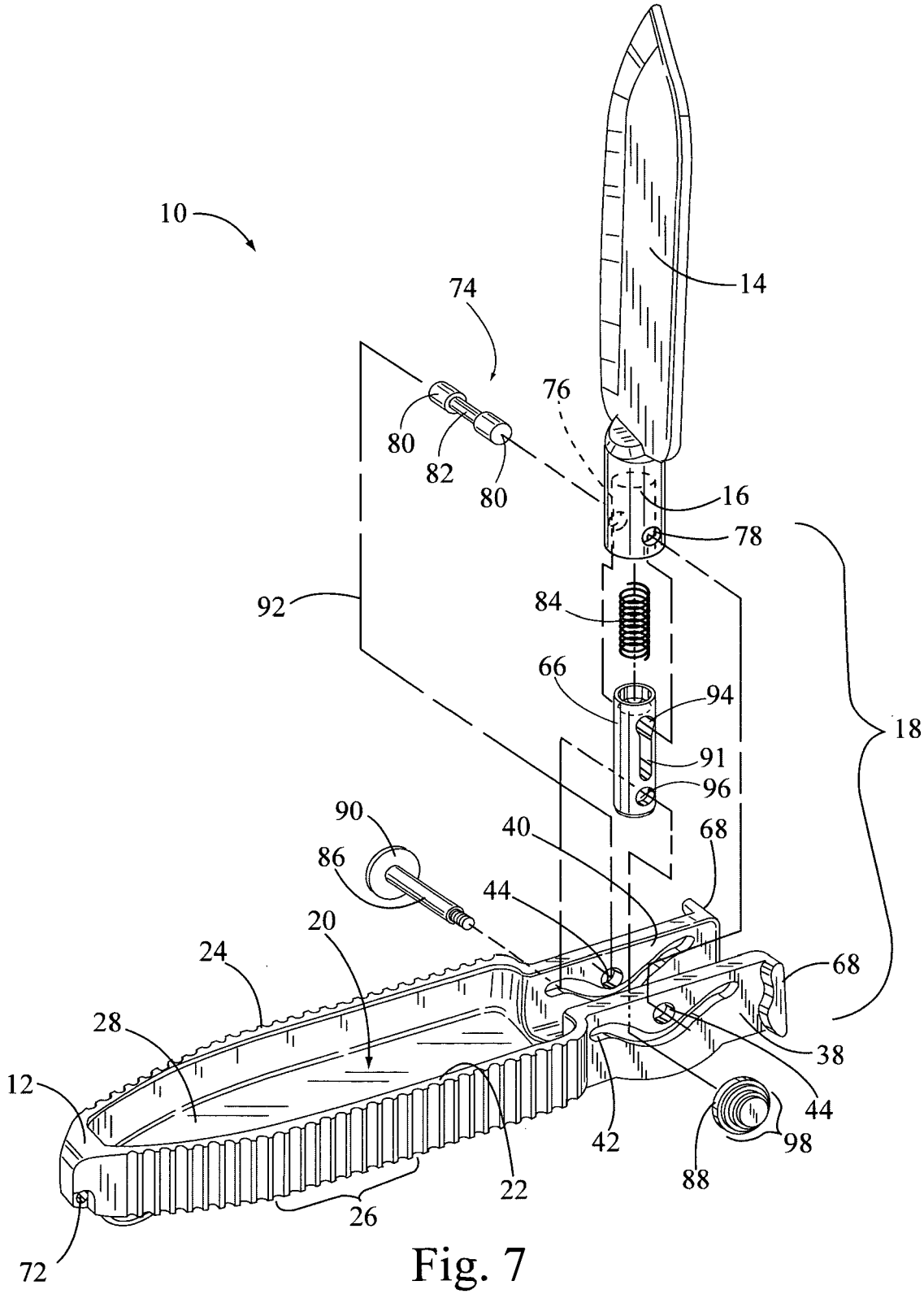
FIG. 7 is an exploded isometric view of the one embodiment of the present invention.

As mentioned above, the knife blade 14 is pivotally attached to the handle 12 by way of a pivot pin 74 at the blade's tang 16. The knife blade is typically forged steel or stainless steel although the blade can also be stamped from sheet. Further, an implement such as a fork, a spoon, a pair of scissors, a file, a pick, a screwdriver, a pair of pliers, and a comb can be specified in place of the knife blade and certain variations and alternative embodiments. As shown in FIG. 7, the knife blade has a cylindrical longitudinally-extending tang. The actual shape and configuration of the tang can vary substantially. For instance it can have an oval, square or rectangular cross section instead of the circular cross section illustrated. A cylindrical bore 76 extends longitudinally into the tang from the proximal end of the knife blade. Like the tang the shape of the bore can vary as well. Further in other variations of the one embodiment and other embodiments, the bore may be omitted altogether depending on the configuration of the actuator mechanism 18. A pivot bore 78 also extends through the tang perpendicularly to the longitudinal axis of the knife blade.

The tang 16 is received in the handle's channel 36 and pivotally secured therein by passing the pivot pin 74 the through the pivot holes 44 in the handle 12 and the pivot bore 78 in the tang. For reasons that will be described below, the diameter of the pivot pin is greater at each of its ends 80 in smaller in its center portion 82. The diameter of the pivot holes and pivot bore correspond with the diameter of the ends. Typically, the pivot pin is comprised of hardened steel, although other materials may be used in variations and alternative embodiments.

Figure 2:
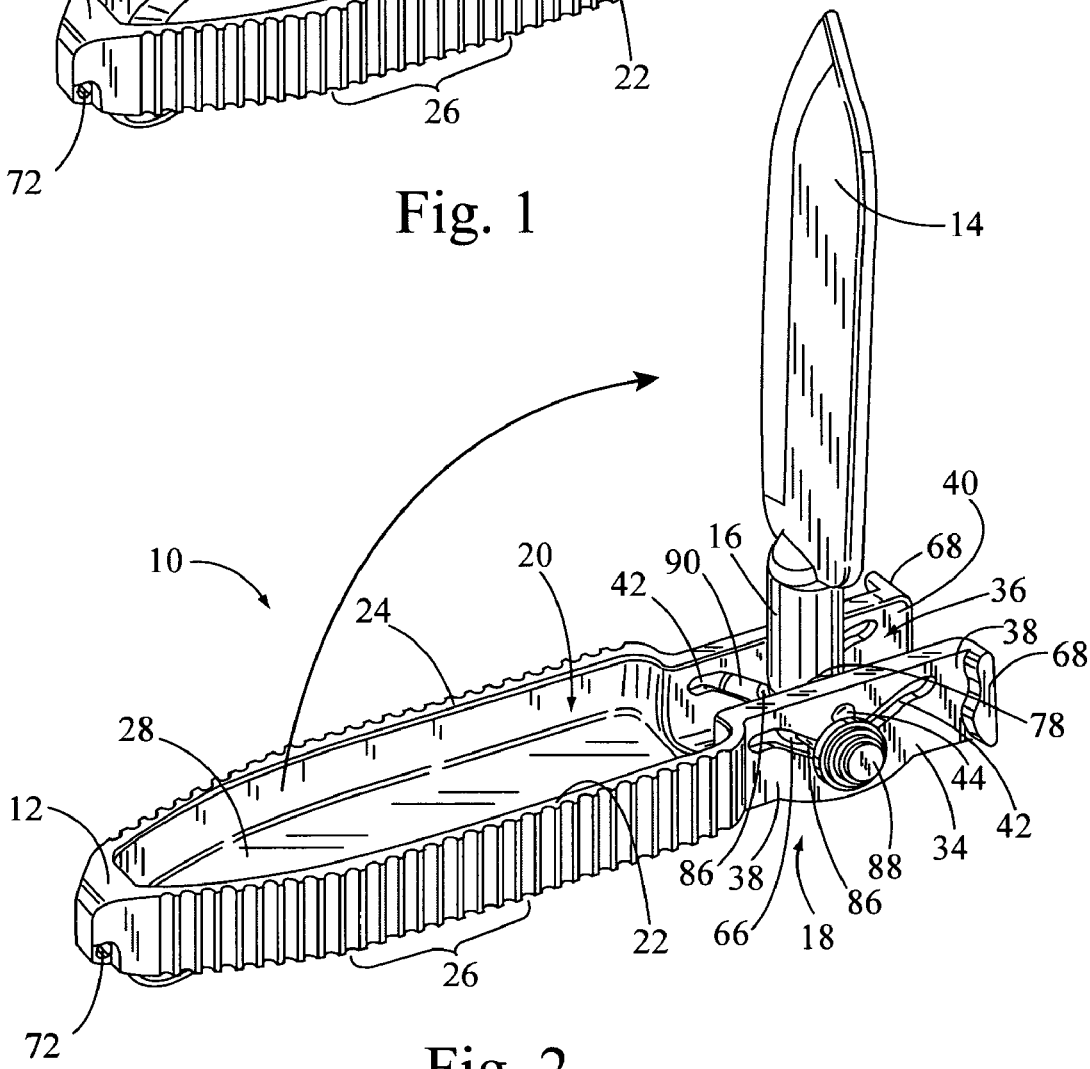
FIG. 2 is an isometric front view of one embodiment of the present invention with the knife blade halfway between the open and closed positions.
Figure 3:
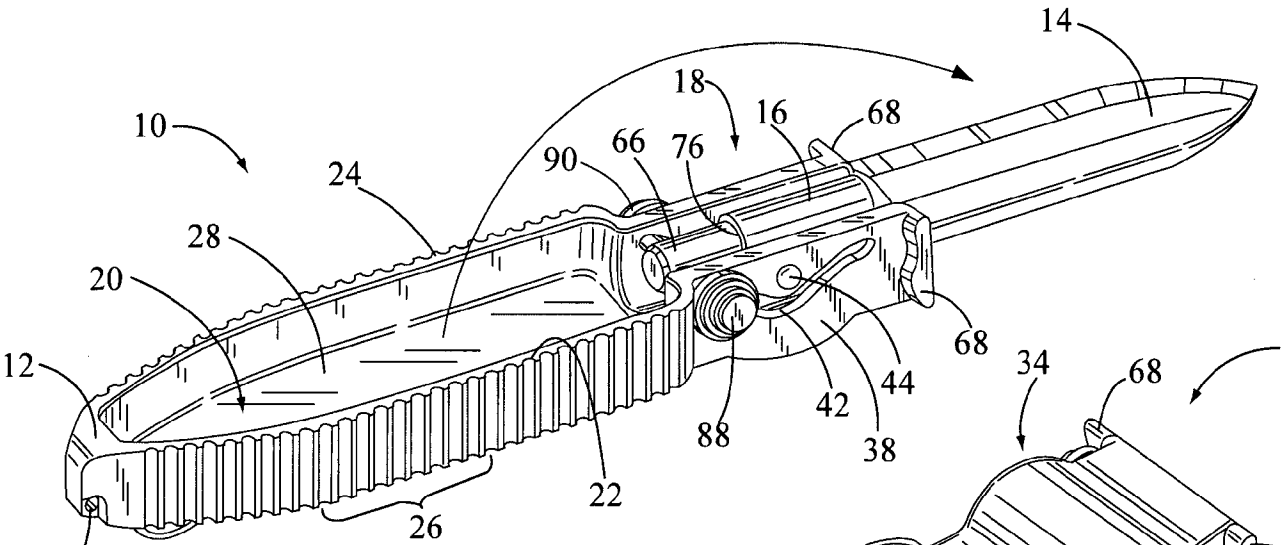
FIG. 3 is an isometric front view of the one embodiment of the present invention with the knife blade in its opened position.

As best illustrated in FIGS. 1–3, the knife blade 14 pivots between its open and closed positions laterally i.e. the blade opens along an arc in a plane that is generally perpendicular to the plane of the blade. The angle between the plane of the arc and the plane of the blade can vary several degrees in either direction (about +−15 degrees) and still be considered generally perpendicular. In other words, the pivot axis is either coincident with the plane of the blade or generally parallel thereto. It is appreciated that when the blade varies from true parallelism with the pivot axis, the knife blade will open at a canted angle relative to the pivot axis and typically the handle 12 as well. Laterally opening folding knives differ from traditional folding knives in that traditional folding knives typically open along a pivot axis that is perpendicular to the plane of the knife blade.

As discussed in the background section above, one of the problems with prior art laterally folding knives is that they can be more difficult to open than traditional folding knives since there is no edge from which to grab the knife blades 14 to pivot the blades from their closed positions. To facilitate opening and closing in the present embodiments, the actuator mechanism 18 is provided. The actuator mechanism comprises, as best illustrated in FIG. 7, all or some of: (i) a coil spring 84; (ii) the pushing element 66; (iii) an actuator shaft 86 with one or more button ends 88 & 90 for fingertip actuation; and (iv) one or more of the aforementioned arcuate slots 42 in the handle 12.

Referring primarily to FIG. 7, the coil spring 84 is received in the longitudinal bore 76 of the knife blade's tang 16 with one end of the spring in contact with the bottom end of the bore. Depending on the specific design of the actuator mechanism 18, the coil spring may not be required for proper operation. Generally, however, the spring is desired to bias the pushing element 66 outwardly of the bore and accordingly, help hold the knife blade locked in either its open or closed position.

Next, the pushing element 66 is received within the bore 76 on top of the coil spring 84 such that the other end of the coil spring is in contact with the top end of the pushing element. The pushing element is typically cylindrical in shape and is slidably received in the tang bore 76 in a tight tolerance fit such that there is little play between the bore and the pushing element. The cross sectional shape of the pushing element can vary to match the cross sectional shape of the bore. In certain variations, a bore and corresponding pushing element have cross sectional shapes that prohibits the relative rotational movement of the pushing element inside the bore, thereby potentially stiffening the connection between the blade 14 and the handle 12 in the open position and helping eliminate any rotational play between the handle and the blade when the blade is in the open position. When the tang 16 is secured its channel 36 in the handle by the pivot pin 74 passing through the pivot holes 44 and the pivot bores 78, the pivot pin also passes through a longitudinally-extending slot 91 in the pushing element as indicated by the dashed line 92. The slot generally has a width substantially similar to the smaller diameter center portion of the pivot pin. The distal end of the slot, however, includes a circular portion 94 having a diameter slightly larger than the larger diameter of the respective ends of the pivot pin.

The circular end portion 94 of the slot 91 facilitates assembly and disassembly of the pivotal connection between the blade 12 and the handle 14. Namely, to place the pivot pin through the both pivot holes 44 and the pivot bore 78, an assembler must align the larger circular portion with the pivot bores and pivot holes such that one of the larger diameter ends 80 of the pivot pin can slide through the slot. In normal operation of the knife, the pushing element 66 slides over the thinner section of the pivot pin. Accordingly, the pivot pin cannot slide out of the pivots bores and holes. To disassembly the folding knife, a person must remove the actuator shaft 86, as described below, to permit the circular end of the pushing element to align with the pivot bores and holes and facilitate slidable removal of the pivot pin.

The pushing element 66 also includes a shaft bore 96 that extends through it near its proximal end. The actuator shaft 86, which passes through both arcuate slots 42, is also received through the shaft bore. Accordingly, by moving the shaft forwardly or rearwardly along the arcuate slot the knife blade 14 is one of opened and closed. As best shown in FIG. 7, one end of the shaft has a button end 88 and the other end is threaded to receive a button nut 90. The button end and the button nut act to hold the shaft in place. Further, the button end and nut include outwardly extending concentric ridges 98 that act as finger or thumb holds to better facilitate the opening and closing of the knife. Preferably, the diameter of the shaft and the diameter of the actuator bore, as well as, the width of the arcuate slots are closely matched to further minimize any play when the blade is in the open position.

One preferred configuration of the arcuate slots 42 is best described with reference to FIG. 5. Starting at the left semicircular end 100 of the illustrated slot, a first portion 102 extends substantially linearly downwardly to the right at an angle of 0–15 degrees relative to the longitudinal axis of the knife blade when in either its open or closed positions. Next, a second portion 104 of the slot extends substantially linearly downwardly at an angle of about 20–40 degrees relative to the longitudinal axis of the knife blade when in either its open or closed positions. A third portion 106 of the slot extending from the second portion is comprised of a true arcuate section having an arc angle of about 40–80 degrees, wherein a line passing through the nadir 46 of the arc and the center point of the pivot hole 44 is substantially perpendicular to the longitudinal axis of the knife blade when in either its open or closed positions. A fourth portion 108 of the slot extends to the right upwardly of the third portion and is generally symmetrical with the second portion about the hypothetical line running through the nadir of the arc and the center point of the pivot hole. A fifth and final portion 110, which is generally symmetrical to the first portion extends upwardly from the fourth portion until terminating in the right semicircular end 112 of the slot. Another important feature of the slot is that the center points of the semicircular ends of the slot are located vertically above the center point (or axis) of the pivot hole. It is noted that for purposes of the interrelationship of the axis of the shaft and pivot pin as well as the center points of the semicircular ends of the slots, vertical is defined as a direction indicated by a line passing through both the axis of the pivot pin and the nadir of the slot and that is substantially normal to the longitudinal axis of the knife blade when the knife blade is in its open position.

Referencing FIGS. 1–3, 5, 6 and 7, the operation of the folding knife 10 is described. Referring first to FIG. 1 illustrating the folding knife in its closed position, a user will typically hold the knife with the back side of the knife resting in his/her palm with the front portion 34 of the handle 12 facing away from the user and with the finger tips gripping the gripping surfaces on the top and bottom wall 22 & 24. Accordingly, the open side of the cavity 20 and the side of the knife blade will be unobstructed to facilitate opening. The user will typically rest his/her thumb on the top button end finger hold 88 of the actuator shaft 86.

To open the blade 14, the user pulls rearwardly on the button end finger hold 88, which causes the shaft 86 to traverse the arcuate slots 42 and move the blade from its closed position in FIG. 1 through the half open position in FIG. 2 to the fully open position of FIG. 3. As the shaft begins to move in the first portion 102 of the slot, the pushing element 66 slides into the bore 76 of the tang 16. As the shaft moves towards and along the second portion 104 of the slot, the pushing element further moves into tang's bore and the knife blade begins to pivot upwardly out of the cavity 20. The pushing element continues to slide into the bore as the knife blade pivots outwardly until the shaft reaches the nadir 46 of the slot in the third portion 106 as shown in FIG. 2.

As the shaft 86 is pulled past the nadir 46 and towards and through the fourth and fifth portions 108 & 110, the pushing element 66 begins to slide out of the bore 76 but the knife blade 14 continues along its arc towards the open position. If the actuator mechanism 18 is equipped with the coil spring 84, the spring will lightly assist in the opening of the knife blade by pushing the pushing element outwardly of the bore, thereby causing the shaft to traverse the remaining portion of the slot and the knife blade to open. As the shaft traverses the fifth portion of the slot, the outside surface of the tang impacts the slight ridges 48, 50 &52 of the tang channel 36 and the knife blade is in its open position.

Referring to FIG. 5, the shaft 86 is illustrated in the position it is in along the slot 42 when the knife blade 14 is fully open. Of particular note is that the shaft does not fully extend to the semicircular end 112 of the slot. In this position the knife blade is locked into the open position for use with minimal free play. In the one embodiment, the three ridges 48, 50 &52 brace the knife blade against moving upwardly or downwardly or rightwardly. The blade is prevented from moving leftwardly by the interaction of the shaft in the slot. As either the ridges and/or the surfaces in the slot wear, the resting place of the shaft moves upwardly along fifth portion 110 to remove any free play that otherwise might result from the wear.

As long as the axis of the shaft 86 is located at a similar vertical position as the axis of the pivot pin 74, the moments incident on the shaft as a result of leftwardly directed side forces against the knife blade 14 will neither cause the pushing element 66 to begin to retract into the tang bore 76 nor the shaft 86 to begin to slide downwardly along the fifth portion 110 of the slot 42. Only when the user pushes the shaft via one of the fingerhold button ends 88 &90 will the shaft begin to retract in essentially the opposite manner as described above concerning the opening of the knife blade. Further, when the shaft has come to rest in the first portion 102 of the slot it will be effectively locked in place until the user again slides the shaft via the fingerhold button ends rearwardly along the slot.

Other Embodiments and Other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, although the folding knife 10 described and illustrated above includes only a single knife blade, other embodiments could include multiple implements coupled with a single handle. In one embodiment, two actuator mechanisms could be located back-to-back with each attached to its own implement. In yet another embodiment, there could be up to four actuator mechanisms controlling four implements with two actuators located on either end of the handle. Other variations as would be obvious to one of ordinary skill given the benefit of this disclosure are also contemplated. While the described embodiment utilizes a monolithic aluminum handle, the handle could be made of multiple pieces of differing shapes and materials. For instance the arcuate slot can be part of a separate plate or structure that is attached in a suitable fashion to the remainder of the handle.

It is further appreciated that the actuator mechanism 18 is not limited in use to laterally opening knives or tools. Rather, the actuator mechanism can be easily adapted for use with a more traditional folding knife or tool. Additionally, the specific construction and configuration of the actuator mechanism can vary greatly. For instance, the pushing element could be adapted to slide along the outside of the tang and accordingly, the tang need not have a longitudinally bore. In other variations, there may only be a single arcuate slot with a single fingerhold button. This configuration to be more suited for the multiple implement tools described in the preceding paragraph. The finger hold button ends themselves need not be buttons or have any particular shape so long as they facilitate the actuation of the actuator mechanism. In the illustrated embodiment, the pivot pin passes all the way through the tang and the pushing element; however, in variations two pivot pins can be specified the only extend partially into the tang from either side of the handle. In such a variation, the longitudinal slot within the pushing element could be eliminated. Numerous other variations of the actuator mechanism as would be obvious to one of ordinary skill in the art have also been contemplated.

I claim:

1. An actuator mechanism for use in conjunction with a folding tool that facilitates the pivotal movement of an implement of the folding tool between a closed position wherein the implement is at least partially contained within a handle of the folding tool and an open position wherein the implement is extended from the handle in a position for use, the actuator mechanism comprising:

a tang at the base of the implement, the tang (i) having a longitudinal axis, (ii) including a bore extending therein along the longitudinal axis with an axis of the bore being substantially parallel to the longitudinal axis, and (iii) being pivotally coupled with the handle along a pivot axis for movement between the open and closed positions, the pivot axis being generally perpendicular to the longitudinal axis;

a pushing element with opposing first and second ends, the pushing element being adapted to slide partially in and out the bore along the bore axis as the implement is moved from its open and closed positions;

a shaft, the shaft (i) being pivotally coupled with the pushing element and (ii) extending longitudinally in a direction generally perpendicular to the longitudinal axis; and at least one generally arcuate slot with at least a portion of the shaft extending through the slot, the slot having a front end and a rear end;

whereby the actuator moves the implement between the open and closed positions in reaction to the sliding of the shaft along the at least one arcuate slot from one of the front and rear ends to the other of the front and rear ends.

2. The actuator mechanism of claim 1, wherein the tang is substantially cylindrical and said bore extends longitudinally.

3. The actuator of claim 2, wherein the bore is substantially cylindrical.

4. An actuator mechanism for use in conjunction with a folding tool that facilitates the pivotal movement of an implement of the folding tool between a closed position wherein the implement is at least partially contained within a handle of the folding tool and an open position wherein the implement is extended from the handle in a position for use, the actuator mechanism comprising:

a tang at the base of the implement, the tang having a longitudinal axis and being pivotally coupled with the handle along a pivot axis for movement between the open and closed positions, the pivot axis being generally perpendicular to the longitudinal axis;

a pushing element with opposing first and second ends, the pushing element being slidably coupled to the tang;

a shaft, the shaft (i) being pivotally coupled with the pushing element and (ii) extending longitudinally in a direction generally perpendicular to the longitudinal axis; and at least one generally arcuate slot with at least a portion of the shaft extending through the slot, the slot having a front end and a rear end;

whereby the actuator moves the implement between the open and closed positions in reaction to the sliding of the shaft along the at least one arcuate slot from one of the front and rear ends to the other of the front and rear ends;

wherein (i) the tang is substantially cylindrical and includes a bore extending longitudinally therein from a proximal end of the tang, (ii) the pushing element is slidably received into the bore, and (iii) a coil spring resides in a bore between the a bore end and the first end of the pushing element.

5. The actuator of claim 1, wherein the shaft has a button end adapted for actuation by the finger of a user.

6. The actuator of claim 1, wherein arcuate slot is formed in the handle of the folding tool.

7. The actuator of claim 1 wherein the arcuate slot extends: (a) along a first portion from a front end linearly and downwardly a first distance at an angle of about 5–25 degrees relative to the longitudinal axis when the implement is in either an open or closed position; (b) from the first portion along a second linear portion downwardly a second distance at an angle of about 20–40 degrees relative to the longitudinal axis when the implement is in either an open or closed position; (c) from the second portion along a third portion for a third distance along a circular arc having an arc angle of about 45–75 degrees; (d) from the third portion along a linear fourth portion upwardly a fourth distance at an angle of about 20–40 degrees relative to the longitudinal axis when the implement is in either an open or closed position; and (e) from the fourth portion along a fifth portion to the rear end linearly and upwardly at an angle of about 5–25 degrees relative to the longitudinal axis when the implement is in either an open or closed position.

8. The actuator of claim 1, wherein a hypothetical linear line passing through both the pivot axis and either a nadir or apex of the generally arcuate slot depending on the orientation of the folding tool is substantially perpendicular to the longitudinal axis of the implement when the implement is in either an open or closed position.

9. The actuator mechanism of claim 1, wherein the actuator mechanism is further adapted to move the implement outwardly and away from a user when being held in a hand of the user when the user slides the shaft along the slot in a generally rearwardly direction towards a body of the user.

10. The actuator mechanism of claim 1, wherein a diameter of the shaft is substantially the same as a width of the generally arcuate slot.

11. The actuator mechanism of claim 1, wherein: (i) tang is pivotally coupled to the handle by a pivot pin, the pivot pin extending along the pivot axis; (ii) the pushing element further includes a pushing element slot, the pushing element slot adapted to permit movement of the pushing element relative to the pivot pin along the longitudinal axis.

12. An actuator mechanism for use in conjunction with a folding tool that facilitates the pivotal movement of an implement of the folding tool between a closed position wherein the implement is at least partially contained within a handle of the folding tool and an open position wherein the implement is extended from the handle in a position for use, the actuator mechanism comprising:

a tang at the base of the implement, the tang (i) having a longitudinal axis, (ii) including a bore having a bore axis with the bore axis extending in a direction substantially parallel to the longitudinal axis therein from a proximal end of the tang and (iii) being pivotally coupled with the handle along a pivot axis for movement between the open and closed positions, the pivot axis being generally perpendicular to the longitudinal axis;

a pushing element with opposing first and second ends, the pushing element being slidably received in the bore and adapted for movement along the bore axis;

a shaft, the shaft (i) being pivotally coupled with the pushing element and (ii) extending longitudinally in a direction generally perpendicular to the longitudinal axis; and at least one generally arcuate slot with at least a portion of the shaft extending through the slot, the slot having a front end and a rear end;

whereby the actuator moves the implement between the open and closed positions in reaction to the sliding of the shaft along the at least one arcuate slot from one of the front and rear ends to the other of the front and rear ends and wherein the handle is of monolithic construction.

13. The actuator mechanism of claim 12, wherein the bore is substantially cylindrical.

14. A folding tool including the actuator mechanism of claim 12 wherein the implement is a knife blade.

15. The folding tool of claim 14, further including a handle with a cavity, the pivot axis being either (i) coincident with a plane of the knife blade or (ii) parallel to the plane of the knife blade, wherein the knife blade is movable about the pivotal axis between a closed position with the blade substantially contained within the cavity and an open position with the knife blade extending outwardly from an end of the handle and being generally longitudinally aligned with the handle.

16. The folding toot of claim 12, wherein the shaft is adapted to slide towards a user's wrist to move the knife blade to the open position wherein it extends outwardly of a hand of the user when the folding knife is held in its normal position.

17. The folding tool of claim 12, wherein the slot is formed in the handle of the knife.

18. The folding tool of claim 12, further including a belt clip coupled to the handle.

19. The folding tool of claim 12, wherein a coil spring resides in the bore.

* * * * *